US005893377A

United States Patent [19]

Chen

[11] Patent Number: 5,893,377

[45] Date of Patent: Apr. 13, 1999

[54] HAIRSTYLING IMPLEMENT WITH DETACHABLE DECORATIVE PIECE

[76] Inventor: Ben S. Chen, 407 E. Duarte Rd., Unit F, Arcadia, Calif. 91006

[21] Appl. No.: 08/869,828

[22] Filed: Jun. 5, 1997

[51] Int. Cl.[6] ..... A45D 8/28

[52] U.S. Cl. ..... 132/275

[58] Field of Search ..... 132/273, 275, 132/276, 277, 278, 279; 24/673, 674, 675, 676

[56] References Cited

U.S. PATENT DOCUMENTS

| | | | |
|---|---|---|---|
| 1,313,331 | 8/1919 | Putter et al. | 24/674 |
| 1,513,710 | 10/1924 | Lewis | 24/676 |
| 1,715,331 | 5/1929 | Richter | 132/275 |
| 3,192,932 | 7/1965 | Hart | 132/275 |
| 3,441,032 | 4/1969 | Barett | 132/275 |
| 5,609,169 | 3/1997 | Yang | 132/279 |
| 5,755,437 | 5/1998 | Chang | 132/279 |

FOREIGN PATENT DOCUMENTS

| | | | |
|---|---|---|---|
| 908561 | 4/1946 | France | 24/673 |
| 27870 | 11/1913 | United Kingdom | 24/673 |
| 736000 | 8/1955 | United Kingdom | 24/673 |

*Primary Examiner*—Todd E. Manahan
*Assistant Examiner*—Eduardo C. Robert
*Attorney, Agent, or Firm*—David and Raymond; Raymond Y. Chan

[57] ABSTRACT

A hairstyling implement with detachable decorative piece includes a hairstyling body for substantially binding, tying or holding a user's hair, a hairstyling base firmly connected to the hairstyling body, at least a fastening device each comprising a first fastener and a second fastener integrally affixed to the hairstyling base for detachably connecting with the first fastener, at least a decorative piece having a decorative front side and a connecting back side to which the first fastener is integrally affixed thereon. Therefore, the decorative piece can be firmly attached to the hairstyling base by connecting the first and second fasteners together. Besides, the decorative piece may also be detached from the hairstyling base by separating the first and second fasteners. Whereby, the user is able to selectively mount various decorative pieces on a hairstyling base in order to increase the variety of hairstyling implement.

6 Claims, 8 Drawing Sheets

HAIRSTYLING IMPLEMENT WITH DETACHABLE DECORATIVE PIECE

FIELD OF THE PRESENT INVENTION

The present invention relates to hairstyling implements such as hair clip, hair fixer, hair clasp, and hair band, and more particularly to a hairstyling implement with detachable decorative piece which enables the user to selectively mount various decorative pieces on a hairstyling base in order to increase the variety of hairstyling implement.

BACKGROUND OF THE PRESENT INVENTION

Conventional hairstyling implement, such as hair clip, hair fixer, hair clasp, and hair band, generally merely includes a hair styling means to tie, bind, hold, or clip a user hair to desired style. In order to provide a decorative feature, some hairstyling implements further include a decorative piece of various shape and color connected to the hair styling means.

As shown in FIGS. 1A and 1B, a conventional hair clasp 11 and hair band 12 for holding and binding hair together are illustrated respectively. FIG. 1C illustrates a hair fixer 13 for holding bangs rearwards. The only way to make such hair clasp 11, hair band 12 or hair fixer 13 become more attractive and decorative is its color and size. Similarly, as shown in FIG. 1D, a hair clip 14 further contains a decorative piece 141 which is a shaped plate affixed to a hair clipper 142, so that the hair clip 14 may increase its stylish variety by changing the shape and color of the decorative piece 141. Moreover, the decorative piece 141 of the hair clip 14 may also designed as a cartoon figure or other decorative figures.

From aged lady to little girl, all female hanker after hairstyling. In order to enhance the decorating effect, even though a woman usually wear just one hairstyling implement at one time, she may spend a lot of money to purchase numerous of hair clips, hair clasps, or hair fixers of different models but having the same function. For example, a woman may like to wear a model of hair clip in the day time and another model of hair clip during a dinner party, so that she needs to entirely release the day wearing hair clip and re-bind her hair with another one. Also, a girl may ask her parents to buy a lot of hairstyling implements decorated with cartoon figures simply because she has a hobby of collecting a series of popular cartoons.

It is understandable for a lady to own many hairstyling implements in view of beauty or collection, but it is unreasonable to buy a lot of hairstyling implements having the identical function. In fact, every hair clip, for example, has an identical function, wherein the only difference for each hair clip is the shape or color of the decorative piece thereof. Therefore, although the purchaser may only be attached to buy a new hair clip due to its newly designed decorative piece, but she is also forced to buy the hair clipper too because it is integrally and rigidly glued to the decorative piece.

Moreover, the decorative piece of the conventional hairstyling implement is simply glued to the hairstyling body. Such glued decorative piece bears a common drawback of easily falling off from the hairstyling body due to the defective of the adhesive material used or the changes of weather temperature.

SUMMARY OF THE PRESENT INVENTION

It is a main objective of the present invention to provide a hairstyling implement with detachable decorative piece which enables the user to selectively mount various decorative pieces on a hairstyling base in order to increase the variety of hairstyling implement.

It is another objective of the present invention to provide a hairstyling implement with detachable decorative piece, wherein the user may feel free to detach the decorative piece(s) from the hairstyling base and re-attach another decorative piece to the hairstyling base very easily while the hairstyling implement is still binding, clipping or tying to the user's hair.

It is still another objective of the present invention to provide a hairstyling implement with detachable decorative piece, in which the decorative piece can be rotated to any desired angle with respect to the hairstyling base and/or another decorative piece mounted on the hairstyling base so as to provide more variety models according to the user's own design and creativity.

It is still another objective of the present invention to provide a hairstyling implement with detachable decorative piece, in which a background unit may be detachably attached to the hairstyling base and the decorative piece(s) is detachably mounted on the background unit, so that the user may selectively change the background for the decorative piece which can be a typical cartoon character or any other animal figure. Of course, the user may also change the decorative piece(s) on the background unit according to the user's creativity.

It is yet another objective of the present invention to provide a hairstyling implement with detachable decorative piece, which comprises an effective fastening means selected from all kinds of connector that it is easy and inexpensive to rigidly install to the hairstyling implement through a laborless manufacturing process.

It is yet another objective of the present invention to provide a hairstyling implement with detachable decorative piece, wherein the decorative piece or the background unit is capable of firmly attached to the hairstyling base without the worry of falling off accidentally unless a predetermined pulling force is applied thereto.

It is yet another objective of the present invention to provide a hairstyling implement with detachable decorative piece which enables the under age user to assembly the decorative and background units following her inclinations or as her please. In other words, the present invention, in fact, not only can function as a hairstyling implement, but also may act as an assembling toy like the building blocks for enhancing the children's creativity.

Accordingly, in order to achieve the above listed objectives, the present invention provides a hairstyling implement with detachable decorative piece which comprises a hairstyling body for substantially binding, tying or holding a user's hair, a hairstyling base firmly connected to the hairstyling body, at least a fastening means each comprising a first fastener and a second fastener integrally affixed to the hairstyling base for detachably connecting with the first fastener, at least a decorative piece having a decorative front side and a connecting back side to which the first fastener is integrally affixed thereon, so that the decorative piece can be firmly attached to the hairstyling base by connecting the first and second fasteners together. Besides, the decorative piece may also be detached from the hairstyling base by separating the first and second fasteners.

The hairstyling implement further comprises at least a background unit having a decorative front surface and a connecting back surface, wherein at least a first fastener is integrally affixed on the connecting back surface and at least a second fastener is integrally affixed on the decorative front surface, so that the background unit can be detachably and firmly attached to the hairstyling base by connecting the first fastener on the connecting back surface of the background unit with the second fastener on the hairstyling base, and that the decorative piece can be detachably and firmly attached to the background unit by connecting the first fastener on the connecting back side of the decorative unit with the second fastener on the decorative front surface of the background unit.

DETAILED DESCRIPTION OF THE PREFERRED EMBODIMENT

Figure 1A:
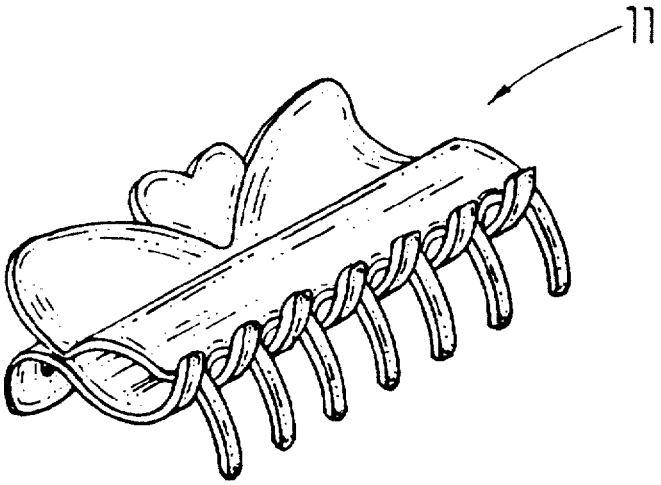
FIG. 1A is a perspective view of a conventional hair clasp.
Figure 1C:
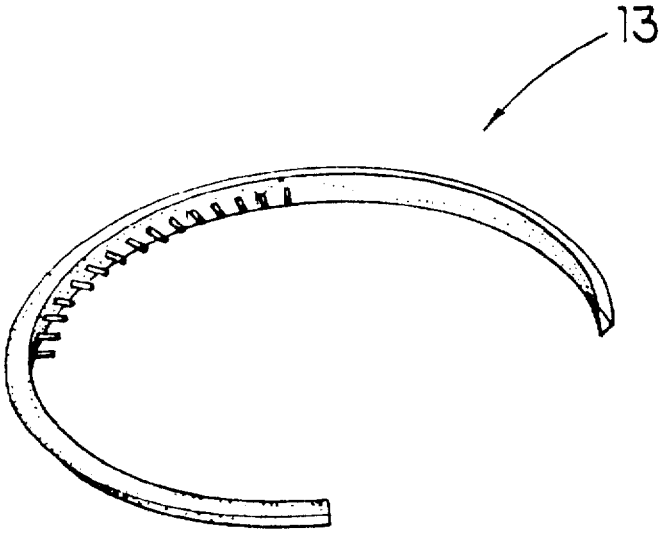
FIG. 1C is a perspective view of a conventional hair fixer.
Figure 1B:
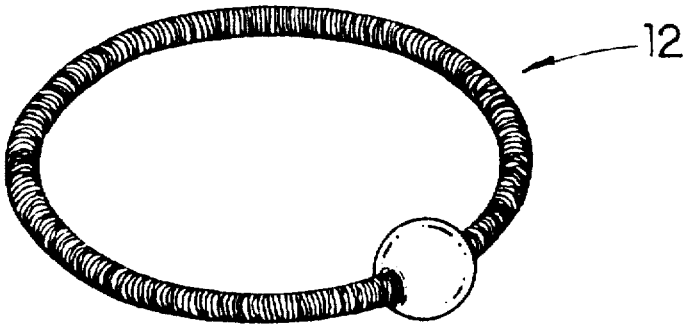
FIG. 1B is a perspective view of a conventional hair band.
Figure 1D:
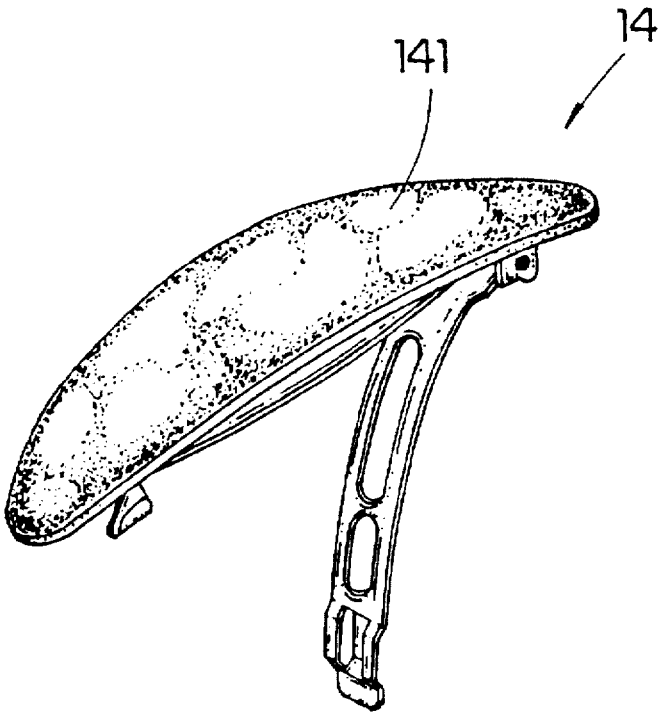
FIG. 1D is a perspective view of a conventional hair clip.
Figure 2:
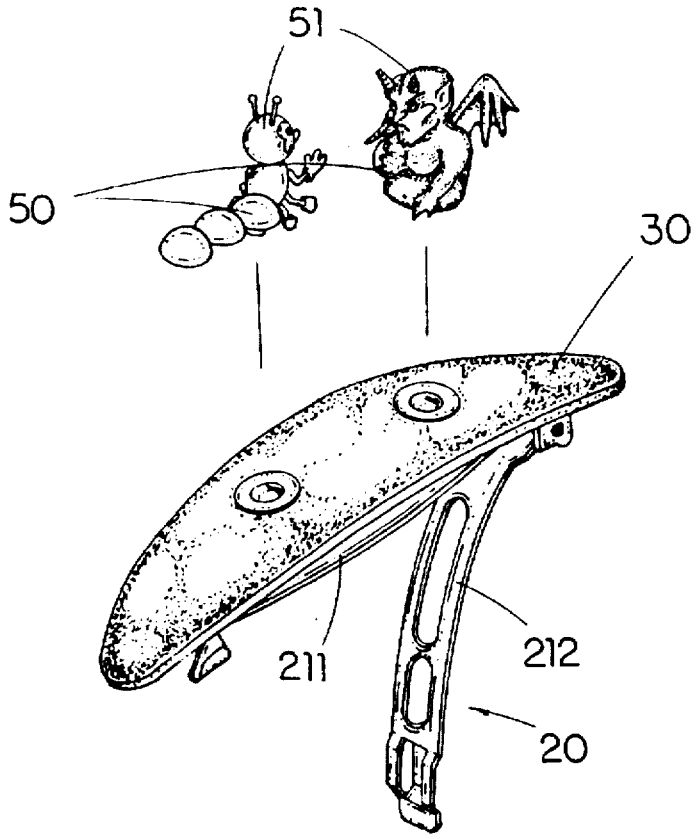
FIG. 2 is a perspective view of a hairstyling implement according to a first preferred embodiment of the present invention.

Generally, hairstyling implement products include, namely hair clips, hair clasps, hair fixers, hair bands, and similar products that are used to tie, bind, hold, or clip a user hair to desired style. Referring to FIGS. 1 and 2, a hairstyling implement with detachable attachment according to a first preferred embodiment is illustrated wherein the subject matter of the present invention is embodied by a hair clip as the hairstyling implement.

The hairstyling implement with detachable decorative piece comprises a hairstyling body 20 for substantially binding, tying or holding a user's hair, a hairstyling base 30 firmly connected to the hairstyling body 20, at least a fastening means 40 comprising a first fastener 41 and a second fastener 42 integrally affixed to the hairstyling base 30 for detachably connecting with the first fastener 41, at least a decorative piece 50 having a decorative front side 51 and a connecting back side 52 to which the first fastener 41 is integrally affixed thereon. Therefore, the decorative piece 50 can be firmly attached to the hairstyling base 30 by connecting the first and second fasteners 41, 42 together. Besides, the decorative piece 50 may also be detached from the hairstyling base 30 by separating the first and second fasteners 41, 42.

The hairstyling body 20 is generally glued or preferably screwed to a bottom surface of the hairstyling base 30 by two screws 31 at two ends of the hairstyling body 20 comprises a traditional clipper 21 for binding the user's hair between a curved clip spring 211 and an engagable clipping plate 212 in a usual manner.

The hairstyling base 30 can be a rectangular board made of plastic or resin by molding or wood, according to this first preferred embodiment, to form a size larger than the hairstyling body 20 and a predetermined thickness at least equal to or thicker than the thickness of the second fastener 42. In order to illustrated an unexpected feature of the present invention, the first preferred embodiment totally provides two decorative pieces 50 intervally attached on the hairstyling base 30, in which each of which is either made of plastic or resin by molding or wood to form a specific and predetermined figure. Each of the decorative pieces 50 can be a cartoon character such as Mickey Mouse, Donald Duck, Superman, and etc., or any other decorative figures such as flower, rainbow, special wording, and etc. Moreover, the two decorative pieces 50 used in the first preferred embodiment can be mutually related with each other, such as one of the decorative pieces 50 is a baseball sports star swinging a baseball bat and the other decorative piece 50 is a baseball, or that one of the decorative pieces 50 is a football player and the other decorative piece 50 is a football.

According to the present invention, each of the decorative pieces 50 is attached onto the hairstyling base 30 by means of the detachable fastening means 40 which must enable the decorative piece 50 to be selectively mounted on the hairstyling base 30 firmly and to be detached from the hairstyling base 30 easily by pulling from the hairstyling base 30 for exchanging for another decorative piece of different decorative figure. Certainly, there are various types of conventional fastening means can be incorporated with the present invention to achieve the above functions. However, if the decorative piece 50 can be rotatably attached onto the hairstyling base 30, the displacing effect of the decorative piece 50 will be largely increased because the figure provided on the decorative front side of the decorative piece 50 can be freely to rotate to any desired angular position. This rotatable feature is especially apparent when two or more decorative pieces 50 are mounted on the hairstyling base 30, in which the decorative effect of the hairstyling implement would become changeful and variable by rotating one decorative piece 50 with respect to another.

Figure 6:
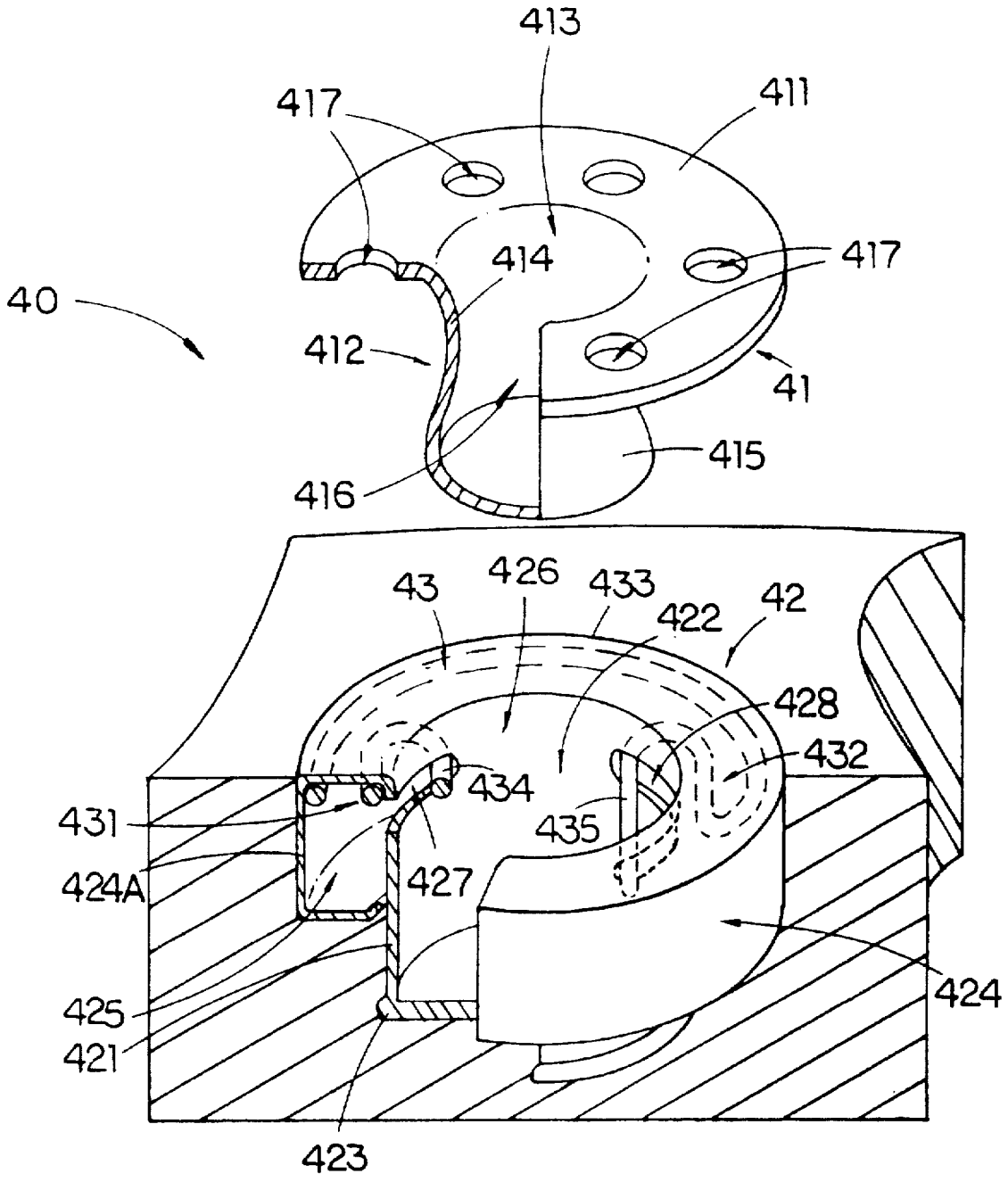
FIG. 6 is a partially exploded view of a fastening means of the hairstyling implement according to the above first and second preferred embodiments of the present invention.

The specific rotatable fastening means 40 equipped with the present invention is illustrated in FIG. 6 which is a partially sectional enlarged perspective view of the rotatable fastening means 40. The first fastener 41 comprises a mounting disc 411 and a hollow inserting head 412 integrally and coaxially connected downwardly from the mounting disc 411. The inserting head 412 has a narrowed neck portion 414 extended from a central hole 413 of the mounting disc 411 and an enlarged buckle head 415 having a diameter substantially larger than the narrowed neck portion 414. The inserting head 412 is a hollow body and defines a holding cavity 416 communicating with the central hole 413, so that the plastic material of the decorative piece 50 can be flowed into the holding cavity 416 through the central hole 413 while forming the decorative piece 50 by injection molding by pre-setting the first fastener 41 within the mold (not shown). Accordingly, the first fastener 41 can be firmly affixed on the connecting back side 52 of the plastic made decorative piece by the plastic material filled inside the holding cavity 416. Furthermore, in order to further ensure the affixing ability, the mounting disc 411 has a plurality of holding holes 417 circularly and spacedly provided thereon to enable the plastic material passing therethrough during molding process to further enhance the attachment of the first fastener 41 to the connecting back side 52 of the decorative piece 50.

If the decorative piece 50 is made of wood or other similar materials by carving, the holding cavity 416 also enables the first fastener 41 to receive more adhesive material to ensure the first fastener 41 being firmly glued onto the connecting back side 52 of the decorative piece 50. Also, the presence of the holding holes 417 can enhance the adhering ability between the first fastener 41 and the connecting back side 52 of the decorative piece 50 since some of the adhesive material applied on the mounting disc 411 may protrude through each holding hole 417 to form a holding stub.

The second fastener 42 of each fastening means 40 comprises a U-shape socket housing 421 defining a receiving socket 422 therein and having an outwardly protruding rim 423 at a bottom end of the socket housing 421. The second fastener 42 further comprises a circular loop shoulder 424 which is formed by extending a top end of the socket housing 421 integrally and outwardly so as to define a circular chamber 425 surrounding an upper portion 426 of the socket housing 421. Two opposite slots 427, 428 are provided along the upper portion 426 of the socket housing 421 to communicate with the circular chamber 425 of the loop shoulder 424. An elastic element 43, which has two S-shaped end portions 431, 432 and a semi-circular middle arc portion 433 connected between the two end portions 431, 432, is arranged inside the circular chamber 425 of the loop shoulder 424, in which the middle arc portion 433 is propped against an outer wall 424A, of the loop shoulder 424 to support two straight end tails 434, 435 of the two end portions 431, 432 respectively extending into the receiving socket 422 of the socket housing 421 through the two slots 427, 428 wherein the two end tails 434, 435 are parallelly disposed to define a distance therebetween which is smaller than the diameter of the receiving socket 422.

Figure 3:
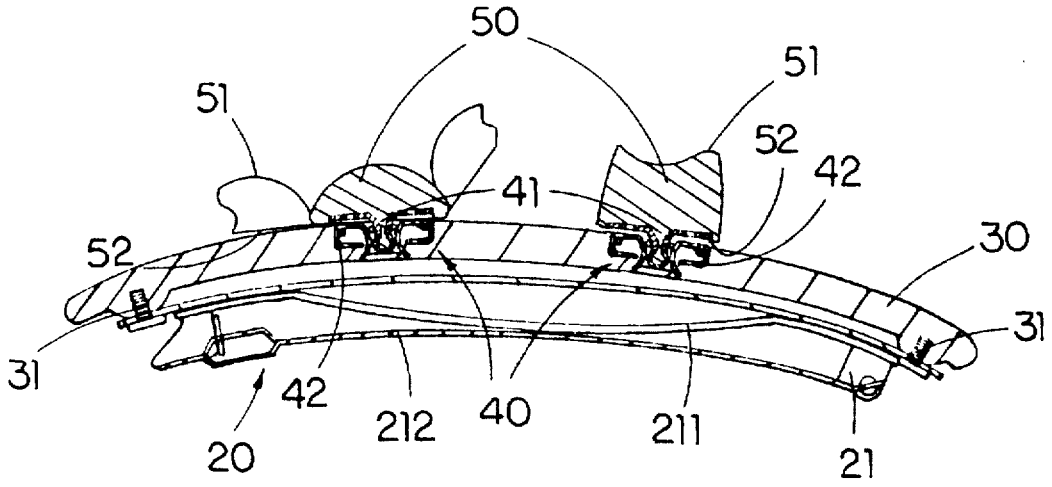
FIG. 3 is a sectional view of the hairstyling implement according to the above first preferred embodiment of the present invention.

As shown in FIGS. 3 and 6, the second fasteners 42 are preset in the injection mold for the hairstyling base 30, so that the plastic or resin material may embed the protruding rim 423 of the socket housing 421 to form a good holding effect capable of firmly engaging the second fasteners 42 on top of the hairstyling base 30. If craving wooden hairstyling base 30 is used, two receiving intention are formed on a top surface of the hairstyling base 30 to receive the two second fasteners 42 respectively. A layer of adhesive material is applied between the receiving indention and the second fastener 42 to firmly secure the second fastener 42 in position. The protruding rim 423 of each second fastener 42 also provides an additional grabbing ability.

To assemble the two decorative pieces 50 onto the hairstyling base 30 is so easy and fast that the user may simply plug the two inserting head 412 of the two first fasteners 41 into the receiving sockets 422 of the second fasteners 42 respectively. The inserting buckle head 415 of the inserting head 412 of each first fastener 41 will forcedly press the two end tails 434, 435 of the elastic element 43 toward the circular chamber 425 in order to enter the receiving socket 422. After the inserting head 412 is plugged into the receiving socket 422, the two end tails 434, 435 are respectively rebound to their original positions and clasped on the narrowed neck portion 414 of the first fastener 41 so as to rotatably retain the inserting head 412 of the first fastener 41 inside the receiving socket 422 of the second fastener 42. In this way, the decorative piece 50 can thus be rotatably attached on top of the hairstyling base 30 by connecting the first and second fasteners 41, 42 together, in which the decorative piece 50 can be freely rotated to any desired angular position by applying a turning force thereto.

In accordance with the present invention, the user is able to detach the decorative piece 50 easily by applying a uplifting force to the decorative piece 50 so that the decorative piece can thus be pulled away from the hairstyling base 30 instantly by pressing the two end tails 434, 435 of the elastic element 43 toward the circular chamber 425 to enable the enlarged buckle head 415 of the first fastener 41 exiting the receiving socket 422 of the second fastener 42.

It is worth to mentioned that a person skilled in art may easily modify the present invention by affixing the first fastener 41 as disclosed above on the hairstyling base 30 and affixing the second fastener 42 as disclosed above to the connecting back side 52 of the decorative piece 50, wherein the same functional characteristic of the above first preferred embodiment can also be achieved.

Figure 4:
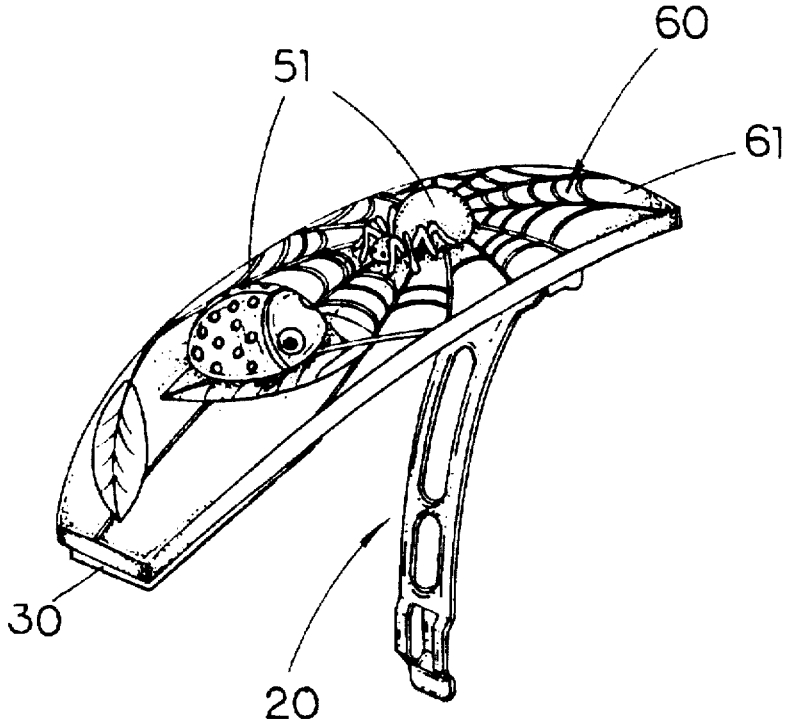
FIG. 4 is a perspective view of a hairstyling implement according to a second preferred embodiment of the present invention.
Figure 5:
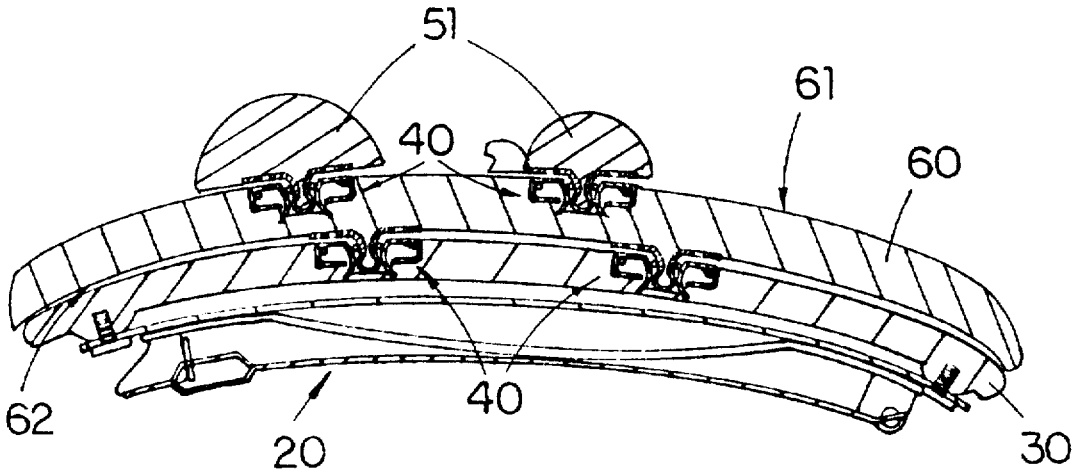
FIG. 5 is a sectional view of the hairstyling implement according to the above second preferred embodiment of the present invention.

As shown in FIGS. 4 and 5, a second preferred embodiment of the present invention is illustrated, in which the hairstyling implement further comprises at least a background unit 60 having a decorative front surface 61 and a connecting back surface 62, wherein the background unit 60 is detachably attached to the hairstyling base 30 by means of at least a fastening means 40 as disclosed in the above first preferred embodiment and the two decorative pieces 50 are also detachably attached to the decorative front surface 61 of the background unit 60 by means of two fastening means 40 as disclosed in the above first preferred embodiment.

In order words, according to the second preferred embodiment, two of said first fasteners 41 (as shown in FIG. 6) are integrally and spacedly affixed on the connecting back surface 62 and two second fasteners 42 (as shown in FIG. 6) are integrally and spacedly affixed on the decorative front surface 61 in the same manner disclosed in the above first preferred embodiment. Therefore, the background unit 60 can be detachably and firmly attached to the hairstyling base 30 by connecting the first fasteners 41 on the connecting back surface 62 of the background unit 60 with the second fasteners 42 on the hairstyling base 30, and that the two decorative pieces 50 can be detachably and firmly attached to the decorative front surface 61 of the background unit 60 by connecting the first fasteners 41 on the connecting back side 52 of each of the decorative pieces 50 with the two second fasteners 42 provided on the decorative front surface 61 of the background unit 60.

Before the present invention, none of the hairstyling implement in the market can provide a changeable background for the decorative figures of the hairstyling implement. According to the second preferred embodiment, the user not only can feel free to exchange the decorative pieces 50 on the background unit 60 with any other decorative pieces 50 with different figures, but also can change the background of those decorative pieces 50 by selectively attaching various background units 60 with different background designs. The variety of the hairstyling implement of the present invention is unlimited that depends on the user's creativity. To those young users, the hairstyling implement of the present invention is more than a hairstyling implement that it actual can also be treated as a toy providing the similar fun of building blocks.

Figure 7A:
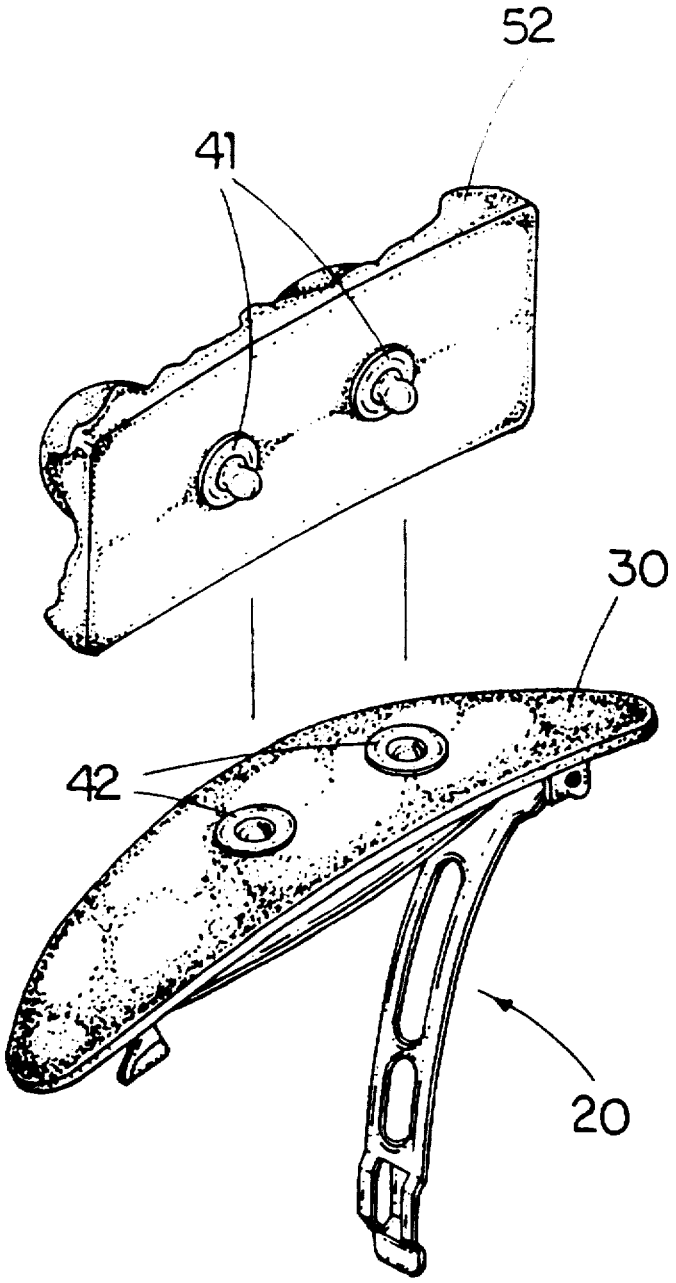
FIG. 7A is a perspective view of a first alternative mode of the present invention.
Figure 7B:
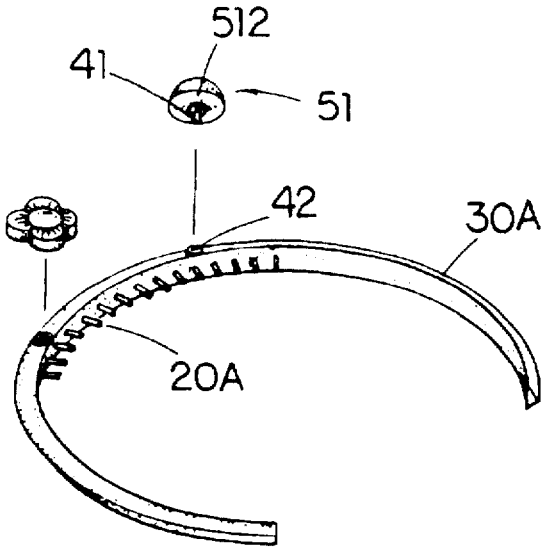
FIG. 7B is a perspective view of a second alternative mode of the present invention.

As shown in FIGS. 7A to 7E, various kinds of the hairstyling implement incorporating with the present invention are illustrated. In FIG. 7A, the hairstyling base 30 having two second fasteners 42 affixed thereon is also adapted for detachably attaching a large size decorative piece 53 which has two first fasteners 41 provided thereunder for respectively detachably connected with the two second fasteners 42 on the hairstyling base 30. As shown in FIG. 73, the hairstyling implement comprises a hair fixer as the hairstyling body 20A, in which the top side of the hairstyling body 20A is acted as the hairstyling base 30A to affix one or more second fastener 42 for connecting with a first fastener 41 affixed to the connecting back side 52 of the decorative piece 50.

Figure 7C:
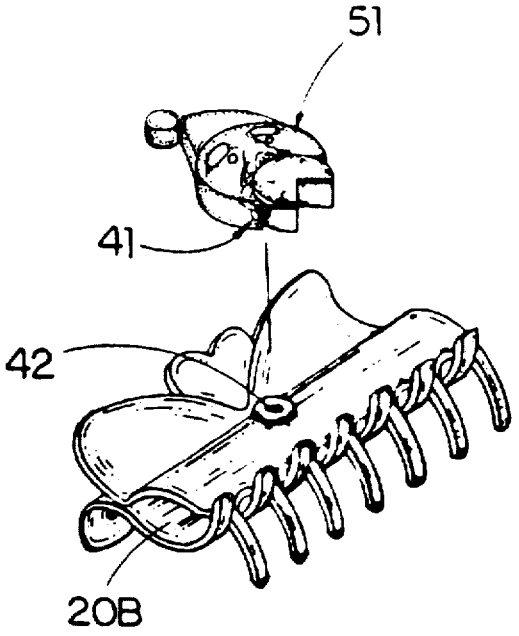
FIG. 7C is a perspective view of a third alternative mode of the present invention.
Figure 7D:
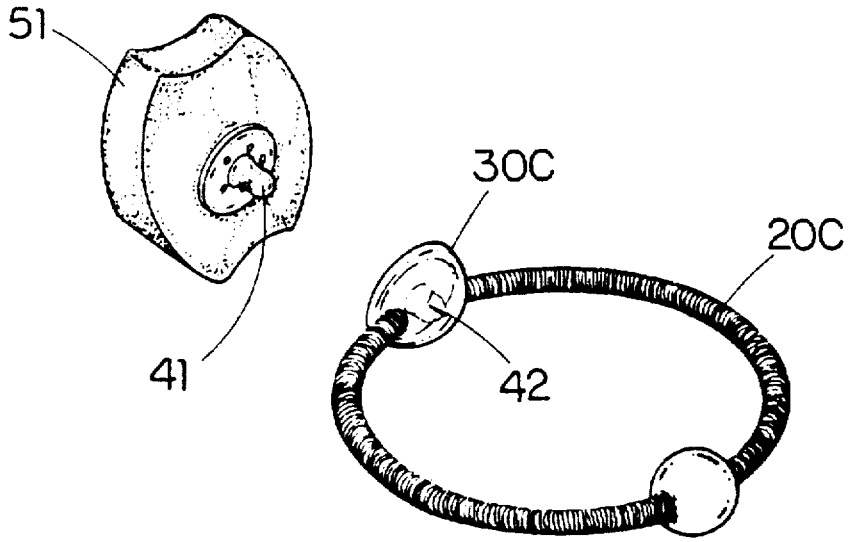
FIG. 7D is a perspective view of a fourth alternative mode of the present invention.
Figure 7E:
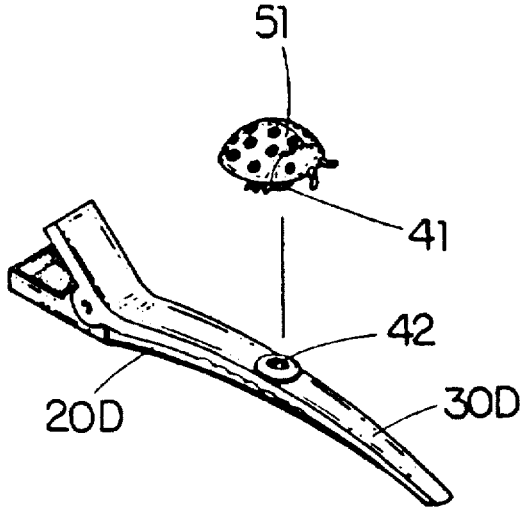
FIG. 7E is a perspective view of a fifth alternative mode of the present invention.

As shown in FIG. 7C, the hairstyling implement comprises a hair clasp as the hairstyling body 20B, wherein one of the operating handles of the hairstyling body 20B which is a clasper is acted as the hairstyling base 30B to affixed with a second fastener 42 for connecting with a first fastener 41 of the decorative piece 50. As shown in FIG. 7D, the hairstyling implement comprises a hair band as the hairstyling body 20C, wherein a conical shape hairstyling base 30C having a second fastener 42 is bound thereon for connecting with a first fastener 41 affixed on the decorative piece 50. As shown in FIG. 7D, the hairstyling implement comprises a clipper as the hairstyling body 20D, in which the top piece of the hairstyling body 20D is acted as the hairstyling base 30D to affix a second fastener 42 thereon for connecting with a first fastener 41 affixed to the decorative piece 50.

The most amazing feature of the present invention is that the user may collect numerous of decorative pieces 50 to selectively attach to different kinds of hairstyling implement. The favorite decorative piece 50 of the user may be attached to a hair clip in one day and attached to a hair band the other day. Accordingly, the user only needs to purchase one for each kind of hairstyling implement and then he or she may selectively attach different kinds of decorative piece thereon for achieving entirely different decorative effect.

In accordance with the present invention, the following remarkable advantages can be achieved.

1. The hairstyling implement with detachable decorative piece of the present invention enables the user to selectively mount various decorative pieces on a hairstyling base in order to increase the variety of hairstyling implement.

2. The user may feel free to detach the decorative piece(s) from the hairstyling base and re-attach another decorative piece to the hairstyling base very easily while the hairstyling implement is still binding, clipping or tying to the user's hair.

3. The decorative piece can be rotated to any desired angular position with respect to the hairstyling base and/or another decorative piece mounted on the hairstyling base so as to provide more variety models according to the user's own design and creativity.

4. A background unit may be detachably attached to the hairstyling base and the decorative piece(s) is detachably mounted on the background unit, so that the user may selectively change the background for the decorative piece which can be a typical cartoon character or any other animal figure. Of course, the user may also change the decorative piece(s) on the background unit according to the user's creativity.

5. The fastening means utilized in the present invention is easy and inexpensive to rigidly install to the hairstyling implement through a laborless manufacturing process, such as integrally molded with the hairstyling base.

6. The decorative piece or the background unit is capable of firmly attached to the hairstyling base without the worry of falling off accidentally unless a predetermined pulling force is applied thereto.

7. The hairstyling implement with detachable decorative piece of the present invention enables the under age user to assembly the decorative and background unit following her inclinations or as her please. In other words, the present invention, in fact, not only can function as a hairstyling implement, but also may act as an assembling toy like the building blocks for enhancing the children's creativity.

I claim:

1. A hairstyling implement, comprising:

a hairstyling body for substantially binding a user's hair;

a first and a second fastening means, wherein each of said fastening means comprises two first fasteners and two second fasteners, each of said first fasteners comprising a mounting disc and an inserting head integrally and coaxially connected downwardly from said mounting disc, said inserting head having a narrowed neck portion extended from said mounting disc and an enlarged buckle head having a diameter substantially larger than said narrowed neck portion, each of said second fasteners comprising a U-shape socket housing defining a receiving socket for detachably receiving and retaining said inserting head of said respective first fastener therein;

a hairstyling base having a size larger than said hairstyling body, and a predetermined thickness at least equal to a thickness of each of said second fasteners, said hairstyling base further having a bottom surface to connect with said hairstyling body, wherein said two second fasteners of said first fastening means are respectively and spacedly embedded on a top surface of said hairstyling base;

at least a background unit, which has a predetermined thickness at least equal to said thickness of each of said second fasteners, having a decorative front surface and a connecting back surface, wherein said two first fasteners of said first fastening means spacedly affixed on said connecting back surface of said background unit, said background unit being detachably attached on said hairstyling base by detachably received and retained said inserting heads of said two first fasteners of said first fastening means inside said two receiving sockets of said two second fasteners of said first fastening means on said hairstyling base respectively, wherein said two second fasteners of said second fastening means are spacedly embedded on said decorative front surface of said background unit; and two decorative pieces each having a decorative front side and a connecting back side, wherein said two first fasteners of said second fastening means are firmly affixed on said connecting back sides of said two decorative pieces respectively, and that said two decorative pieces are able to detachably attached on said decorative front surface of said background unit by inserting said two inserting heads of said two first fasteners of said second fastening means into said two receiving sockets of said two second fasteners of said second fastening means provided on said decorative front surface of said background unit.

2. A hairstyling implement, as recited in claim 1, wherein each of said second fasteners of said first and second fastening means further has an outwardly protruding rim at a bottom end of said socket housing to provide an additional grabbing ability, a circular loop shoulder which is formed by extending a top end of said socket housing integrally and outwardly so as to define a circular chamber surrounding an upper portion of said socket housing, two opposite slots provided along said upper portion of said socket housing to communicate with said circular chamber of said loop shoulder, an elastic element which has two S-shaped end portions and a semi-circular middle arc portion connected between said two end portions being arranged inside said circular chamber of said loop shoulder, in which said middle arc portion is propped against an outer wall of said loop shoulder to support two straight end tails of said two end portions respectively extending into said receiving socket of said socket housing through said two slots, wherein said two end tails are parallelly disposed to define a distance therebetween and smaller than said diameter of said receiving socket.

3. A hairstyling implement, as recited in claim 1, wherein each of said inserting heads of said first and second fastening means is a hollow body and defines a holding cavity communicating with said central hole, wherein said holding cavity enables said first fastener to receive more adhesive material to ensure said first fastener being firmly glued onto said connecting back side of said decorative piece and said connecting back surface of said background unit, and that said mounting disc has a plurality of holding holes circularly and spacedly provided thereon which enable some of said adhesive material applied on said mounting disc may protrude through each holding hole to form a holding stub.

4. A hairstyling implement, as recited in claim 3, wherein each of said second fasteners of said first and second fastening means further has an outwardly protruding rim at a bottom end of said socket housing to provide an additional grabbing ability, a circular loop shoulder which is formed by extending a top end of said socket housing integrally and outwardly so as to define a circular chamber surrounding an upper portion of said socket housing, two opposite slots provided along said upper portion of said socket housing to communicate with said circular chamber of said loop shoulder, an elastic element which has two S-shaped end portions and a semi-circular middle arc portion connected between said two end portions being arranged inside said circular chamber of said loop shoulder, in which said middle arc portion is propped against an outer wall of said loop shoulder to support two straight end tails of said two end portions respectively extending into said receiving socket of said socket housing through said two slots, wherein said two end tails are parallelly disposed to define a distance therebetween and smaller than said diameter of said receiving socket.

5. A hairstyling implement, as recited in claim 1, wherein each of said inserting heads of said first and second fastening means is a hollow body and defines a holding cavity communicating with said central hole, so that plastic material of said decorative pieces and said background unit is able flow into said holding cavity through said central hole while forming said decorative pieces and said background unit by injection molding, and that said mounting disc has a plurality of holding holes circularly and spacedly provided thereon to enable said plastic material passing therethrough during molding.

6. A hairstyling implement, as recited in claim 5, wherein each of said second fasteners of said first and second fastening means further has an outwardly protruding rim at a bottom end of said socket housing to provide an additional grabbing ability, a circular loop shoulder which is formed by extending a top end of said socket housing integrally and outwardly so as to define a circular chamber surrounding an upper portion of said socket housing, two opposite slots provided along said upper portion of said socket housing to communicate with said circular chamber of said loop shoulder, an elastic element which has two S-shaped end portions and a semi-circular middle arc portion connected between said two end portions being arranged inside said circular chamber of said loop shoulder, in which said middle arc portion is propped against an outer wall of said loop shoulder to support two straight end tails of said two end portions respectively extending into said receiving socket of said socket housing through said two slots, wherein said two end tails are parallelly disposed to define a distance therebetween and smaller than said diameter of said receiving socket.

* * * * *